United States Patent [19]

Goforth

[11] Patent Number: 4,819,837

[45] Date of Patent: Apr. 11, 1989

[54] AEROSOL STATIC DISSIPATOR

[75] Inventor: Melvin L. Goforth, Amarillo, Tex.

[73] Assignee: Tech Spray, Inc., Amarillo, Tex.

[21] Appl. No.: 822,011

[22] Filed: Jan. 24, 1986

[51] Int. Cl.[4] ..... B65D 83/00

[52] U.S. Cl. ..... 222/402.1; 361/215; 361/220

[58] Field of Search ..... 222/402.1, 394, 105; 361/212, 215, 220; 174/6; 239/340, 289

[56] References Cited

U.S. PATENT DOCUMENTS

| | | | |
|---|---|---|---|
| 1,564,855 | 12/1975 | Jurs | 361/215 |
| 3,982,157 | 9/1976 | Azuma et al. | 361/215 |
| 4,394,705 | 7/1983 | Blackman | 361/215 |
| 4,457,456 | 7/1984 | Derby et al. | 222/105 |
| 4,555,744 | 11/1985 | Maroney et al. | 361/212 |

FOREIGN PATENT DOCUMENTS

| | | | |
|---|---|---|---|
| 28874 | 2/1983 | Japan | 361/212 |

*Primary Examiner*—Joseph J. Rolla
*Assistant Examiner*—Kenneth Noland
*Attorney, Agent, or Firm*—Wendell Coffee

[57] ABSTRACT

A metal tube is substituted for the plastic tube commonly connected to the actuator of aerosol spray cans of contact cleaning fluid. The brass tube is electrically connected by a wire to the electronic component being sprayed. An alligator clip or banana plug at the end of the wire provides a convenient connection to the circuit board. In one embodiment, a resistor connects the brass tube to a metal button positioned on the actuator to contact the finger of a person depressing the actuator to operate the aerosol can, and the person is grounded. In another embodiment, the brass tube is grounded as well as connected to the circuit board, and the person operating the actuator is insulated from the brass tube. In either embodiment, the brass tube effectively dissipates any static electricity generated by the aerosol stream or spray to the selected ground.

8 Claims, 2 Drawing Sheets

AEROSOL STATIC DISSIPATOR

BACKGROUND OF THE INVENTION:

(1) Field of the Invention

This invention relates to spraying an aerosol stream onto electronic components, and more particularly to reducing static from such aerosol streams.

(2) Description of the Prior Art

Before my invention, aerosol sprays or streams were used to apply contact cleaning fluids and other substances onto circuit boards and other electronic components.

A typical aerosol can has an outlet valve that discharges the propellant and contact cleaning fluid through an actuator when the actuator is depressed. A nozzle in the actuator discharges the pressurized fluids in a fine mist or spray.

For accurate application in crowded, difficult to reach, places on electronic circuit boards and in electronic devices, small diameter plastic tubes, typically ranging in length from six (6) inches to twenty-four (24) inches, are inserted into a socket or recess around the nozzle of the actuator. The aerosol stream is discharged from the nozzle through the tube and out of an open end of the tube at the desired point of application. A standard tube size is 0.085 inches outside diameter, 0.050 inches inside diameter.

One problem inherent in spraying such aerosol streams is the static electricity generated by the movement of the sprayed material. Although such static electricity may have a voltage as little as 100 to 200 millivolts, as little as six (6) millivolts is sufficient to cause damage to some sensitive electronic devices. Therefore, it is desirable to eliminate static to the extent feasible from any aerosol stream used in applying substances to electronic components.

Some aerosol manufacturers have placed additives in the aerosol can that would reduce static build up as the contents were sprayed from the can. However, most static reducing additives leave an undesirable residue on the circuit boards and contacts, and are somewhat expensive.

SUMMARY OF THE INVENTION (1) New Function and Surprising Results

My invention dissipates static electricity from aerosol streams without the need for chemical additives. The plastic tubes used with aerosol cans before my invention are replaced by an electrically conductive tube, such as a brass tube. A wire soldered or attached with a crimped band to the brass tube is preferably connected to the circuit board or electronic component being sprayed. The static electricity normally generated during the spraying is collected by the metal tube and dissipated through the wire.

It is sometimes necessary to ground either or both the person and can. In this case, it is preferred to electrically connect the finger operating the actuator to the tube with a resistor. The resistor protects the operator from any voltage sources the tip of the brass tube may contact.

However, it is preferred to isolate the person operating the actuator from any possible electrical current the tip of the metal tube may encounter. For this embodiment of my invention, the tube is electrically connected to the circuit board and to a ground, and the person and can electrically insulated from the metal tube.

Therefore, using only a metal tube and wire, my invention obtains the unexpected result of eliminating static from aerosol spray, without antistatic fluids and the like.

Thus, it may be seen that the total function of my invention far exceeds the sum of the functions of the individual parts such as actuator, aerosol can, nozzle, etc.

(2) Objects of this Invention

An object of this invention is the dissipation of static electricity from an aerosol stream or spray.

Further objects are to achieve the above with a device that is sturdy, compact, durable, lightweight, simple, safe, efficient, versatile, ecologically compatible, energy conserving, and reliable, yet inexpensive and easy to manufacture, attach, connect, operate and maintain.

Other objects are to achieve the above with a method that is versatile, ecologically compatible, energy conserving, rapid, efficient, and inexpensive, and does not require skilled people to attach, connect, operate, and maintain.

The specific nature of the invention, as well as other objects, uses, and advantages thereof, will clearly appear from the following description and from the accompanying drawing, the different views of which are not scale drawings.

Figure 1:
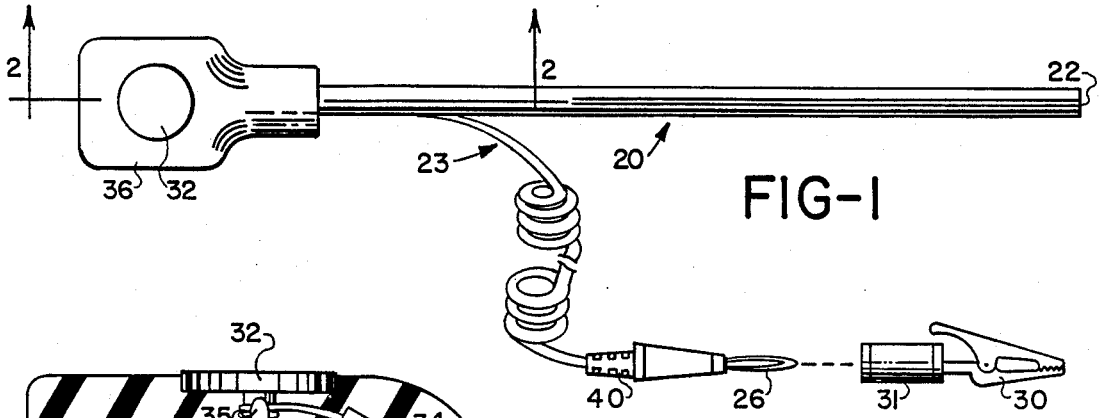
FIG. 1 is a top view of a static dissipating device according to the invention.

As an aid to correlating the terms describing this invention to the exemplary drawing the following catalog of elements is provided:

CATALOG OF ELEMENTS

10: actuator
12: outlet valve
14: aerosol can
16: nozzle
18: socket
20: brass tube
21: tube insulation
22: discharge end
23: wire
24: wire insulation
25: solder connection
26: banana plug
28: electronic board
30: alligator clip
32: metal button 31: adaptor
34: resistor
35: solder connection
36: housing
38: tension reliever
40: tension reliver
42: work station
43: person
44: wrist strap
46: wrist button
47: finger
48: wrist wire
50: ground connector
52: can strap
54: can wire
56: ground connector
58: ground wire
60: ground
110: actuator
116: nozzle
118: socket
120: metal tube
121: tube insulation
122: discharge end
124: wire
126: wire
128: crimped band
130: banana plug
132: banana plug
134: wire insulation
136: tension reliever
138: tension reliever
140: wire insulation
142: tension reliever
143: adaptor
144: alligator clip
145: adaptor
146: alligator clip
150: housing
152: tension reliever

DESCRIPTION OF THE PREFERRED EMBODIMENTS

The term "electronic component" is broadly used in describing the invention and shall be understood to include any circuit board, or electronic device or assembly of electronic devices. Those with ordinary skill in the art will be familiar with the types of circuit boards and plugs, receptacles, chassis, frames, and the like utilized in interconnecting electronic components to form an electronic device or apparatus. Such persons will also be familiar with the contact cleaning or other aerosol and solid sprays utilized in connection with such electronic components.

The term "aerosol spray" and "aerosol can" shall be understood to include any of the containers of contact cleaning or electronic component treatment fluid or spray, solid, or fluid, utilized in the electronics industry and sprayed onto electronic components. This invention is useful with sprays onto electronic components where potential static electricity presents a danger to sensitive electronic devices.

FIGS. 1 through 4 describe an embodiment for use when the person operating the actuator is grounded and electrically connected to the device. Actuator 10, commonly constructed of electrically nonconductive plastic materials, is adapted to be fluidly connected, or is fluidly connectable, to outlet valve 12 of aerosol can 14. The aerosol can 14 for this embodiment contains contact cleaning fluid and aerosol propellant. Of course, as described above, other substances for application to electronic components could also be contained in the can 14.

The actuator 10 has nozzle 16 therein, and a recess or socket 18 around the nozzle 16. The socket 18 is sized to snugly receive a plastic tube (not shown), commonly of about 0.085 inches outside diameter. The actuator 10, can 14 amd outlet valve 12 are well known in the art, as is the plastic tube, described above in the Summary of the Invention section. The can 14, outlet valve 12, actuator 10, and nozzle 16 all form spray means for dispensing an aerosol stream.

Figure 2:
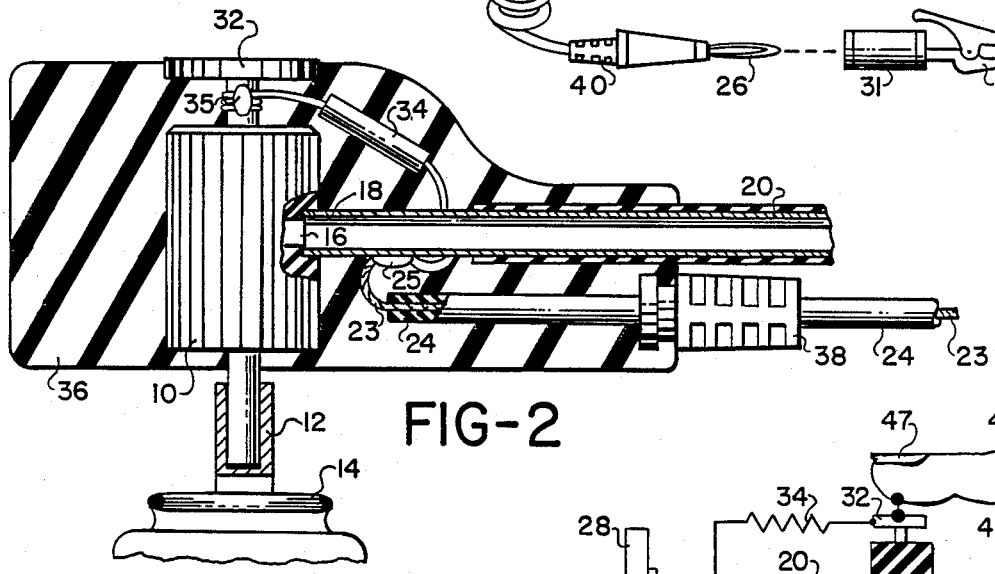
FIG. 2 is a side sectional view taken substantially along line 2—2 of FIG. 1.
Figure 4:
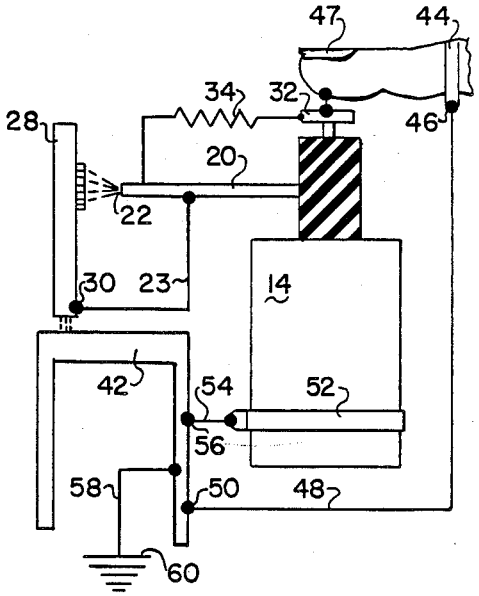
FIG. 4 is a schematic diagram of the electrical circuit formed when the static dissipating device shown in FIGS. 1, 2, and 3 is used.
Figure 3:
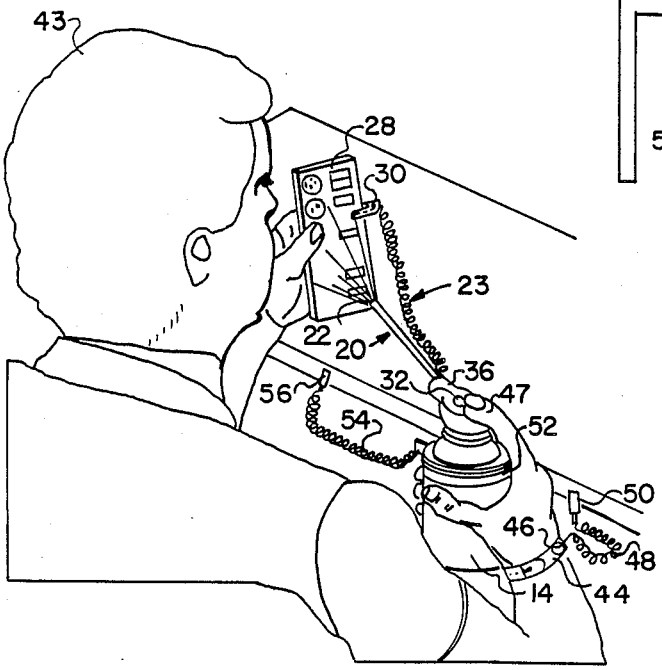
FIG. 3 is a perspective view of a person holding the device shown in FIGS. 1 and 2, showing the preferred electrical connections.

In addition to FIGS. 2 and 3, showing the structural connection of the device, FIG. 4 also provides an electrical schematic diagram showing the grounding circuits completed when my invention is used.

One end of electrically conductive tube 20 is fit or inserted into the socket 18. As with the previously used plastic tube (not shown), the tube 20 is preferably 0.085 inches outside diameter. When in the socket, a bore of the tube 20 is fluidly connected to the nozzle 16 for discharge of any aerosol spray or stream from the nozzle through the tube, and out of an open discharge end 22 of the tube 20. The tube 20 is preferably brass, but may be made of metal or other electrically conductive material. The bore of the tube is preferably mirror finished, or extremely smooth, to facilitate flow of the aerosol stream through the tube.

Wire 23 is attached for electrical conduction to the tube 20, preferably at solder connection 25, proximate the end of the tube 20 that has been inserted into the socket 18. The wire 23 is preferably covered with wire insulation 24 for its length. A connector, such as banana plug 26, is attached at an other end of the wire 23 for electrically connecting the tube 20 through the wire 23 and plug 26 to a selected ground. The preferred selected ground is the electrical component to be sprayed, such as electronic board 28.

The wire 23 may be attached to any electronic component not having the appropriate socket or hole or receptacle for the banana plug, by alligator clip 30. As shown in FIG. 1, the alligator clip preferably has an adaptor 31 into which the banana plug 26 may be inserted, thereby providing an optional connector in the form the alligator clip 30.

The tube 20 is preferably electrically insulated along its length with tube insulation 21, such as heat shrinkable tubing, placed around the tube 20. The tubing insulation prevents inadvertently short circuiting components or devices. The tube insulation 21 preferably extends to and even with, the discharge end 22 of the tube 20.

Metal button 32 is positioned where the finger of a person operating the actuator would normally be positioned. For the embodiment, the metal button 32 is located at the top of the actuator 10.

The metal button 32 is preferably electrically connected to the tube 20 by resistor 34. As shown in FIG. 2, the resistor 34 is preferably crimped at one end to the metal button 32 and second by solder connection 25, and second at the other end to the tube 20 at the solder connection 25 of the wire 23. The resistor 34 affords some protection for the person operating the actuator 10, in the event that the discharge end 22 of the tube 20 should contact portion of the circuit board having a voltage. For most electronic devices with which this invention will be used, the voltages are not high. As described above in the summary of the invention section, as little as six (6) microvolts is sufficient voltage to damage such electronic components. Thus a 2 kiloohm resistor as the resistor 34 should prove adequate to prevent annoying shocks at the metal button.

A standard actuator 10, such as commonly found on the disposable aerosol cans typically used in the electronics industry, may be used in connection with this invention. However, it is preferred to utilize a variable actuator to permit selection of the spray discharge desired, thus allowing more precise and accurate treatment of the electronic components. Use of the more expensive variable actuator becomes more feasible when the actuator is used many times with successive cans of aerosol, instead of being disposed of with empty cans 14.

Therefore it is preferred to enclose the resistor, actuator and button, and a portion of the tube and wire, as well as the soldered connection 25, within a nonconductive, molded plastic housing 36. The housing 36 serves to lock the tube 20 into the socket 15 of the actuator 10, provides a bulkier structure for holding during attachment and removal from the cans 14, makes for a more rugged device, and protects the resistor and electrical connections from impacts and corrosive or harmful materials.

Tension reliever 38 is attached around the wire 23 and retained within the housing 36 where the wire extends from the housing 36, to isolate the soldered connection 25 from the force of any tension placed on the wire. The wire 23 is also preferably coiled so that when in its coiled form it is about 8½ to 10 inches long and when fully extended, will be is three to six (3–6) feet long. Tension reliever 40 is also preferably attached around the wire 23 and retained within the banana plug at the connection of the banana plug to the coiled wire to relieve the soldered connection of the banana plug from tensile forces exerted on the wire, thereby enhancing the durability of that connection.

Referring to FIGS. 3 and 4, work station 42 has an electronic board 28 thereon. The alligator clip 30 is shown attached to the board 28 resting on the work station 42. A person 43 is shown holding the can 14 to which the actuator 10 is connected.

Two methods of grounding the can and person are shown. Wrist strap 44 has metal wrist button 46 thereon in contact with skin of the person 43. Wrist wire 48 extends from the wrist button 46 to a ground connnection 50 on the work station. Alternately, the can 14 may be grounded by metal can strap 52 encircling the can 14, with coiled can wire 54 extending from the can strap 52 to ground connection 56 on the work station 42. The work station or table 42 is preferably metal, and connected to ground 60 by ground wire 58. Although it is preferred to ground the can and the person, it would be sufficient to ground either alone.

One method for dissipating the static electricity from the aerosol stream or spray includes attaching the alligator clip 30 or banana plug 26 to the board, discharging the aerosol through the tube 20 by depressing the actuator 10, and spraying the aerosol stream from the open discharge end 22 of the tube 20. The brass tube 20 collects and dissipates the static electricity through the wire 23 to the selected ground, preferably in the form of the circuit board 28 being sprayed. Additionally any static build up that might occur on the person 43 or on the can 14 will dissipated by the grounds to the grounded work station.

Thus, all static electricity that might damage sensitive devices or components on the circuit board is effectively eliminated. When spraying is completed on the circuit board, the alligator clip is disconnected and again connected to the next circuit board. As cans of aerosol are used up, the static dissipator device and the can strap 52 would be exchanged to a new can 14.

Figure 5:
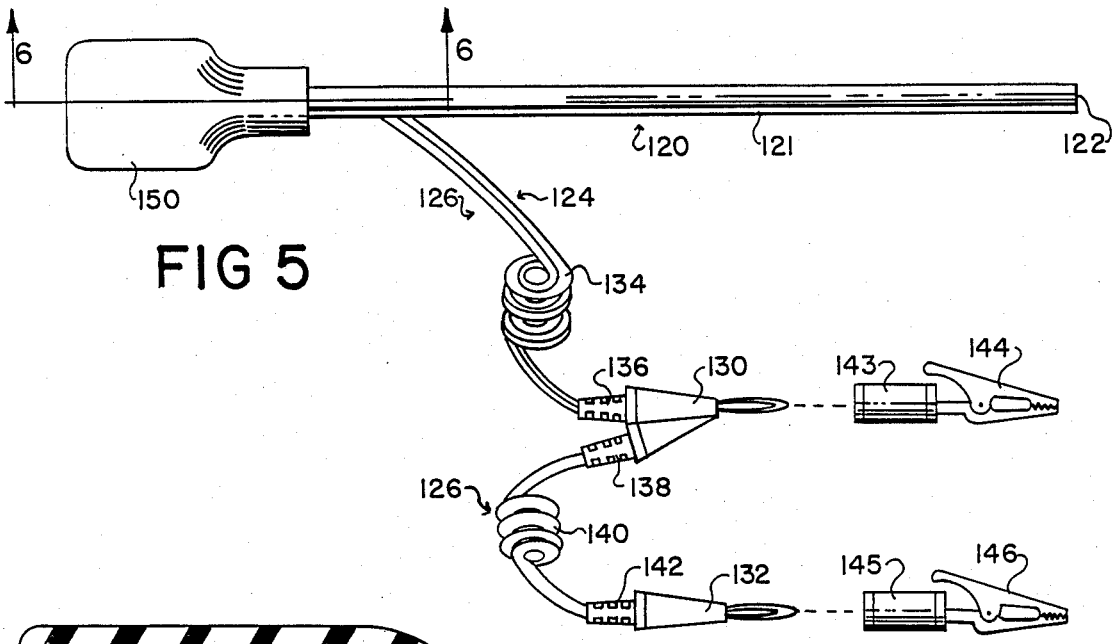
FIG. 5 is a top view of another embodiment of my invention.
Figure 6:
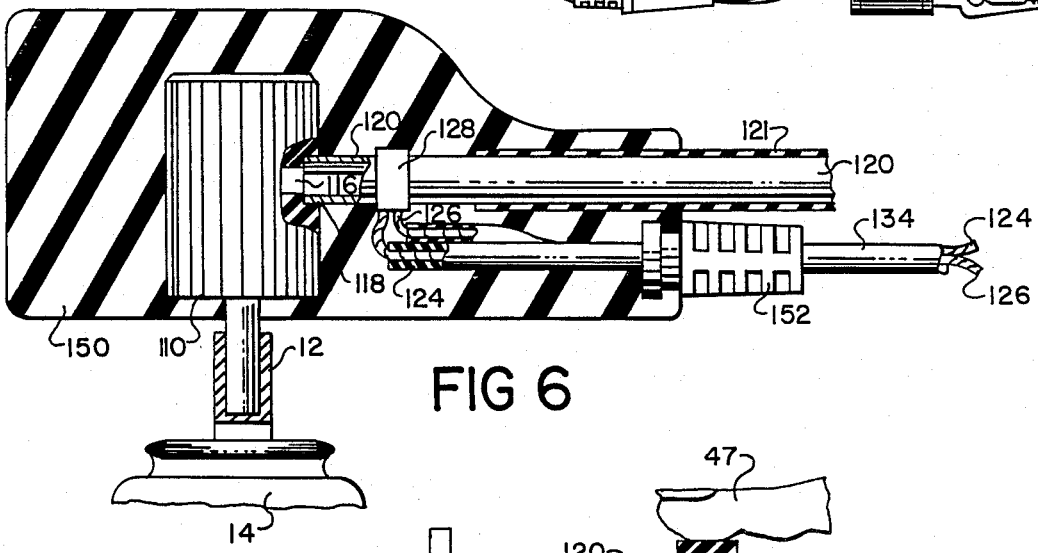
FIG. 6 is a side sectional view taken substantially along lien 6—6 of FIG. 5.
Figure 7:
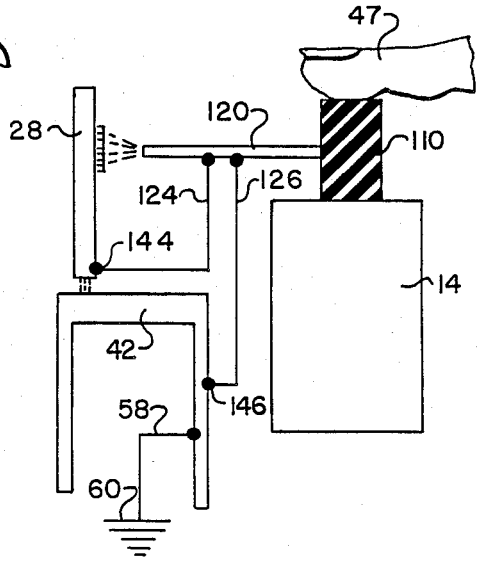
FIG. 7 is a schematic diagram of the electrical circuit formed when the device shown in FIGS. 5 and 6 is used.

FIGS. 5, 6, and 7 show the preferred embodiment where the person operating the device is insulated from the circuit board and metal tube. Actuator 110 is fluidly connectable to the outlet valve 12 of the aerosol can 14, and is preferably substantially identical to the actuator 10. Housing nozzle 116 and socket 118 are preferably similar to the nozzle 16 and socket 18.

Brass tube 120 has tube insulation 121 and discharge end 122, similar to the tube 20, tube insulation 21 and discharge end 22. The brass tube 120 has a bore that is fluidly connected to the nozzle 116 at the socket 118 for discharge of an aerosol stream from the nozzle 116 through the tube 120 and out of the discharge end 122.

Wires 124 and 126 are each attached at one end for electrical conduction to the tube 120 proximate the socket 118, preferably by crimped band 128. The wires 124 and 126 are electrically connected at the other ends to banana plugs 130 and 132, respectively. For convenience and to produce a more useable device, the wire 126 is paired with the wire 124 and insulated by insulation 134 from the tube 120 to the banana plug 130. Tension relievers 136 and 138 at the banana plug 130 function similarly to the tension reliever 40.

The wire 126 preferably extends from the banana plug 130, in the form of a two conductor wire insulated by insulation 140, to the banana plug 132. Tension reliever 142 of the banana plug 132 functions similarly to the tension reliever 40. Alligator clips 144 and 146 with adaptors 143 and 145, respectively, are each similar to the alligator clip 30 and adaptor 29 and provide alternate connectors for the banana plugs 130 and 132 connectors for electrically connecting the brass tube 120 through the wire 124 and 126 to two selected grounds.

As with the other device shown in FIGS. 1 through 4, the actuator 110, tube 120, and connection of wires 124 and 126 by the crimped band 128 are enclosed by housing 150. The housing 150 is similar to the housing 36, except no resistor or metal button is included, and the two insulated wires 130 and 132 extend therefrom below the tube 120.

Tension reliver 152 is similar to the tension reliever 38, except that it is attached to both of the wires 124 and 126 over the insulation 134. Additionally, the wires 124 and 126 are preferably coiled, such as with common telephone cords, between the tension relievers 152 and 136, and between the tension relievers 138 and 142.

FIG. 7 shows the completed electrical circuit when the embodiment shown in FIGS. 5 and 6 is used. The finger 47 of the person is insulated from the metal tube 120 by the actuator 110 and the housing 150. The tube 120 is electrically connected by the wire 124 to the circuit board 28 by the alligator clip 144 through the wire 124, banana plug 130, and adaptor 143. The tube 120 is also electrically connected directly to the work station 42, and thus to the ground 60 through the ground wire 58, by the wire 126, banana plug 132, adaptor 145 and alligator clip 146.

Thus, the embodiment of FIGS. 5 through 7 dissipate static electricity from the tube 120 and circuit board 38 to ground by a path other than through the person pressing the actuator 110.

The embodiment shown and described above is only exemplary. I do not claim to have inverted all the parts, elements, or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A device for dissipating static electricity from an aerosol stream, comprising:

a. an actuator having a nozzle, b. the actuator being fluidly connectable to an outlet valve of an aerosol can containing an aerosol propellant for discharging and aerosol stream through said nozzle, c. an electrically conductive tube fluidly connected to the nozzle at one end and open at an opposite, discharge end, so that any aerosol stream discharged from said nozzle will flow through the tube and out of the discharge end, d. an electrically conductive wire electrically connecting the tube and a connector, e. the connector providing means for electrically connecting the tube through the wire to a selected ground, and f. a can fluidly connecting to the actuator being grounded when the actuator is operated.

2. A device for dissipating static electricity from an aerosol stream, comprising:

a. an actuator having a nozzle, b. the actuator being fluidly connectable to an outlet valve of an aerosol can containing an aerosol propellant for discharging an aerosol stream through said nozzle, c. an electrically conductive tube fluidly connected to the nozzle at one end and open at an opposite, discharge end, so that any aerosol stream discharged from said nozzle will flow through the tube and out of the discharge end, d. an electrically conductive wire electrically connecting the tube and a connector, e. the connector providing means for electrically connecting the tube through the wire to a selected ground, f. the selected ground being an electronic component to be sprayed with an aerosol stream, g. said tube being electrically insulated from a person operating the actuator, h. a second wire being electrically connected to said tube, and i. said second wire providing means for electrically connecting the tube to another selected ground.

3. The invention as defined in claim 2 including all of the limitations a. through i. with the addition of the following limitation:

j. an electrically nonconductive housing enclosing the actuator and a portion of the tube and the wires.

4. A device for dissipating static electricity from an aerosol stream, comprising:

a. an actuator having a nozzle, b. the actuator being fluidly connectable to an outlet valve of an aerosol can containing an aerosol propellant for discharging an aerosol stream through said nozzle, c. an electrically conductive tube fluidly connected to the nozzle at one end and open at an opposite, discharge end, so that any aerosol stream discharge from said nozzle will flow through the tube and out of the discharge end, d. an electrically conductive wire electrically connecting the tube and a connector, e. the connector providing means for electrically connecting the tube through the wire to a selected ground, f. an electrically conductive contact button positioned on the actuator for contact with a person operating the actuator, g. the actuator being substantially electrically nonconductive, and h. the contact button electrically connected to the tube.

5. The invention as defined in claim 4 including all of the limitations a. through h. with the addition of the following limitation:

i. a housing enclosing the actuator and a portion of the tube and the wire, and retaining the button on the actuator, with a portion of the button exposed in position to contact a person operating the actuator.

6. The invention as defined in claim 4 including all of the limitations a. through h. with the addition of the following limitation:

i. a resistor forming the electrical connection of the contact button and the tube.

7. The invention as defined in claim 6 including all of the limitations a. through i. with the addition of the following limitation:

j. a housing enclosing the actuator, resistor, and a portion of the tube and the wire, and retaining the button on the actuator, with a portion of the button exposed in position to contact a person operating the actuator.

8. The invention as defined in claim 7 including all of the limitations a. through j. with the addition of the following limitation:

k. a tension reliever about the wire, retained within the housing, at a position where the wire extends from the housing, for substantially isolating the electrical connection of the wire and the tube from tensile forces exerted on the wire.

* * * * *